United States Patent [19]

Levine

[11] 4,115,720

[45] Sep. 19, 1978

[54] DEVICE HAVING THERMIONIC CATHODE HEATED BY FIELD-EMITTED ELECTRONS

[75] Inventor: Jules David Levine, East Brunswick, N.J.

[73] Assignee: RCA Corporation, New York, N.Y.

[21] Appl. No.: 783,220

[22] Filed: Mar. 31, 1977

[51] Int. Cl.[2] ..... H01J 1/20; H01J 19/10

[52] U.S. Cl. ..... 313/337

[58] Field of Search ..... 313/336, 337, 346

[56] References Cited

U.S. PATENT DOCUMENTS

| | | | |
|---|---|---|---|
| 2,509,053 | 5/1950 | Calbick | 313/336 X |
| 3,440,475 | 4/1969 | Schiller et al. | 313/337 |
| 3,745,342 | 7/1973 | Le Poole | 313/337 |
| 3,928,783 | 12/1975 | Hosoki et al. | 313/346 |

*Primary Examiner*—Saxfield Chatmon, Jr.
*Attorney, Agent, or Firm*—E. M. Whitacre; G. H. Bruestle; L. Greenspan

[57] ABSTRACT

Electronic device comprising an evacuated envelope containing a main thermionic cathode heated solely by energetic electrons emitted from an unheated auxiliary field-emission cathode.

7 Claims, 1 Drawing Figure

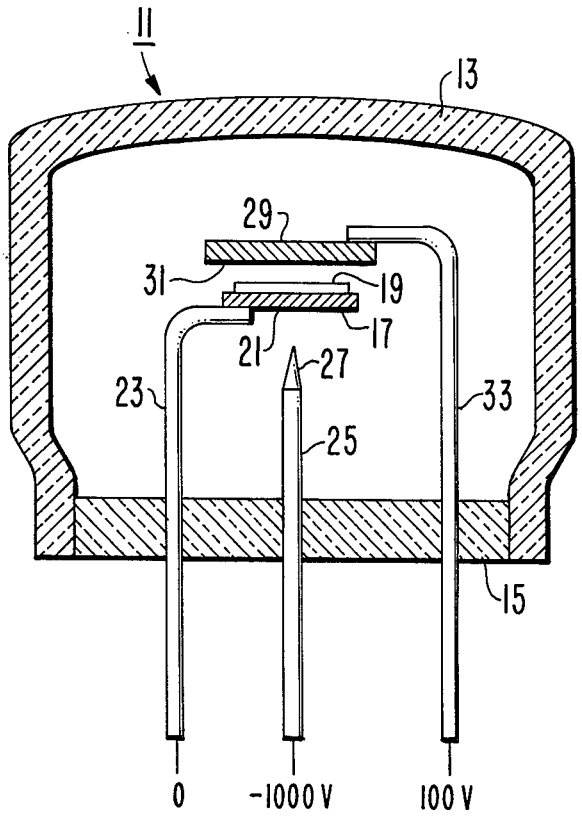
11
13
29
31
19
17
21
27
23
33
25
15
0
-1000 V
100 V

DEVICE HAVING THERMIONIC CATHODE HEATED BY FIELD-EMITTED ELECTRONS

BACKGROUND OF THE INVENTION

This invention relates to an electronic device having an indirectly-heated cathode which is heated solely by electrons which are emitted from an associated unheated auxiliary field-emission cathode.

It has been suggested previously to heat an indirectly-heated cathode by field emission. See, for example, U.S. Pat. Nos.:

2,509,053 to C. J. Calbick,
2,552,047 to J. Kurshan,
2,953,701 to A. J. Gale,
3,474,282 to H. Katz et al., and
3,521,113 to A. N. Broers.

Each of these references discloses a main thermionic cathode that is indirectly heated by electrons emitted from an auxiliary cathode, which is itself heated by some other means. The auxiliary cathode may be a thermionic emitter or a field emitter.

SUMMARY OF THE INVENTION

The novel device is similar to prior devices except that there is no means present for heating the auxiliary cathode. Instead, the auxiliary cathode has a point or edge and there is provided means for producing, between the main and auxiliary cathode, an electric field of sufficient magnitude to cause the auxiliary cathode to emit electrons by field emission with sufficient energy that, when absorbed by the main cathode, heats the main cathode sufficiently to cause thermionic emission therefrom. Such structure requires the application of considerably higher voltages than are ordinarily used. But, lower heater power is required, lower costs for materials and assembly are possible and, due to the lower mass of the assembly, shorter start-up time is possible for the novel device.

BRIEF DESCRIPTION OF THE DRAWING

The sole FIGURE is a sectional elevational view of one embodiment of the novel device.

DESCRIPTION OF THE PREFERRED EMBODIMENT

The sole FIGURE is a vacuum diode. The diode comprises an evacuated glass envelope 11 including a bulb 13 and a stem 15 which is hermetically sealed to the bulb 13 and closes the envelope 11. Inside the bulb 13 is a main thermionic cathode comprising a base 17 of cathode nickel carrying on a first surface a thermionic oxide coating 19. In this example, the coating 19 is about 0.1 cm in diameter. The opposing second surface 21 of the base 17 is adapted to absorb energetic electrons which may strike it. The base 17 is supported on a cathode lead 23 which passes through the stem 15 and serves as an external electrical connection to the main cathode.

An auxiliary field emission cathode comprises a kovar wire 25 terminating in a point 27 that is closely spaced from the base 17. The wire 25 passes through the stem 15 and serves as an external electrical connection to the auxiliary cathode. Instead of terminating in a point, the auxiliary cathode may be a metal wire terminating in a chisel edge. The point or edge should be capable of field emission. Methods of producing points and edges that are capable of field emission are well known. It is also known to provide a plurality of points or edges which are capable of field emission. One simple method for producing suitable points or edges is to crimp a kovar wire and then to etch it until the wire separates into two pieces at the thinnest part. The chisel edge corner produced by etching is then used as the edge or point for field emission. The point or edge of the auxiliary cathode has an effective radius of about $10^{-4}$ cm, but because of the preparation process, it is quite jagged. When different voltages are applied between the cathode lead 23 and the wire 25, high field regions are produced adjacent the jagged protuberances which yield field emission. The spacing of the point or edge 27 to the second surface 21 of the base 17 is about $10^{-2}$ cm in this example. The materials used are those metals which form sharp points or chisel edges. The electric field that is effective for producing field emission at the jagged protuberances is about 2 to $8 \times 10^7$ volts/cm.

An anode comprises a metal plate 29, which may be of nickel-chromium alloy, that is spaced from the coating 19. The surface 31 of the plate 27 facing the coating 19 is adapted to absorb electrons emitted from the coating 19. The plate 29 is supported by an anode lead 33 which passes through the stem 15 and serves as an electrical connection to the anode. The anode can be shaped or planar; and it can be solid or have an aperture through which an electron beam can pass as in a kinescope electron gun. Since the auxiliary cathode (the field emitter) runs cold, no cooling is necessary for this component.

In one mode of operation, ground or zero potential is applied to the main cathode, while about −1000 volts are applied to the auxiliary cathode and about +100 volts are applied to the anode. With a current flow of about 0.5 milliampere through the auxiliary cathode, corresponding to an input power of about 0.5 watt, the main cathode passes about 5 milliamperes, corresponding to an output power of about 0.5 watt.

In still another mode of operation, ground or zero potential is applied to the main cathode, while about −1500 volts are applied to the auxiliary cathode and about +100 volts are applied to the anode. With a current flow of about 0.5 milliampere through the auxiliary cathode, corresponding to an input power of about 0.75 watt, the main cathode heats to about 800° to 900° C and passes about 5 milliamperes, corresponding to an output power of about 0.5 watt.

It is expected that the voltages between main cathode and auxiliary cathode can be about 500 to 5000 v, and the spacings therebetween can be less than about 0.01 cm. The main cathode can be heated to temperatures up to about 2000° K. The conductive path of the main cathode can be designed to provide low heat losses. This may be done by using one or more thin supports of metal for element 23.

I claim:

1. An electronic device comprising an evacuated envelope containing a main thermionic cathode having a first surface adapted to emit electrons when heated to elevated temperatures and an opposed second surface which is adapted to absorb energetic electrons and to convert the energy of said electrons to heat, an auxiliary field-emission cathode adapted to emit energetic electrons toward said second surface and spaced from said second surface, and means for applying a voltage between said main cathode and said auxiliary cathode, said voltage being of sufficient magnitude to cause a field emission of electrons from said auxiliary cathode with sufficient energy when absorbed by said second surface to heat said main cathode to cause thermionic electron emission from said first surface, there being no other means for heating said main cathode and said auxiliary cathode in said device.

2. The device defined in claim 1 wherein said first surface carries a thermionic oxide cathode coating.

3. The device defined in claim 1 wherein said auxiliary cathode comprises a single pointed element with the point thereof in the direction of said second surface.

4. The device defined in claim 1 wherein said auxiliary cathode comprises a plurality of pointed elements with the points thereof in the direction of said second surface.

5. The device defined in claim 1 wherein said voltage is about 0.5 to 5 kilovolts.

6. The device defined in claim 5 wherein said voltage produces a field of about 50 to 500 kilovolts per centimeter.

7. The device defined in claim 1 wherein said auxiliary cathode comprises a single element having a chisel edge pointed in the direction of said second surface.

* * * * *